United States Patent [19]

Spies et al.

[11] 4,378,132

[45] Mar. 29, 1983

[54] MINING METHOD AND APPARATUS

[76] Inventors: Klaus Spies, Beckerstr. 51, Aachen-Brand, Fed. Rep. of Germany; Harry J. Fitzgerald, 2662 Cedarvue Dr., Pittsburgh, Pa. 15241

[21] Appl. No.: 235,144

[22] Filed: Feb. 17, 1981

[51] Int. Cl.[3] ..... E21C 41/04; E21D 15/00

[52] U.S. Cl. ..... 299/11; 299/12; 405/288

[58] Field of Search ..... 299/11, 12; 405/288, 405/289, 290

[56] References Cited

U.S. PATENT DOCUMENTS

| | | | |
|---|---|---|---|
| 2,521,888 | 9/1950 | Wilson | 299/12 X |
| 3,591,542 | 7/1971 | Bonnel et al. | 299/11 X |
| 3,650,564 | 3/1972 | Williamson | 299/12 X |
| 4,030,752 | 6/1977 | Simpson | 299/11 |
| 4,175,481 | 11/1979 | Burgess | 405/288 X |
| 4,255,071 | 3/1981 | Koppers et al. | 405/290 |
| 4,277,204 | 7/1981 | Koppers et al. | 405/288 |

*Primary Examiner*—Ernest R. Purser
*Attorney, Agent, or Firm*—Michael J. Striker

[57] ABSTRACT

A method of single-entry mining of coal and analogous minerals is disclosed, which permits substantially 100% extraction of the coal or other mineral in a seam. All operations are carried out under hydraulic steel roof supports adjacent the mine face; farther back the roof is supported by non-yielding cast-in-situ pillars of quick-setting concrete rather than coal pillars or other supports. Mining machinery for these purposes is also disclosed.

7 Claims, 18 Drawing Figures

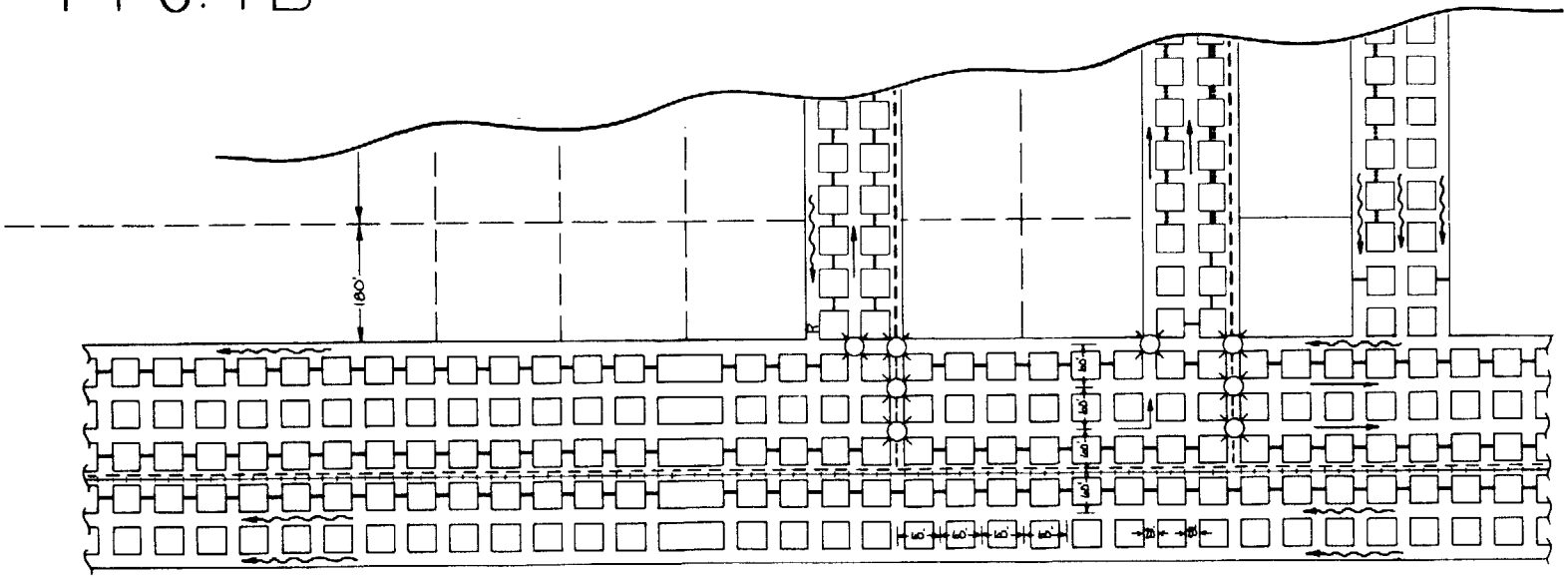
.080
.080
.080

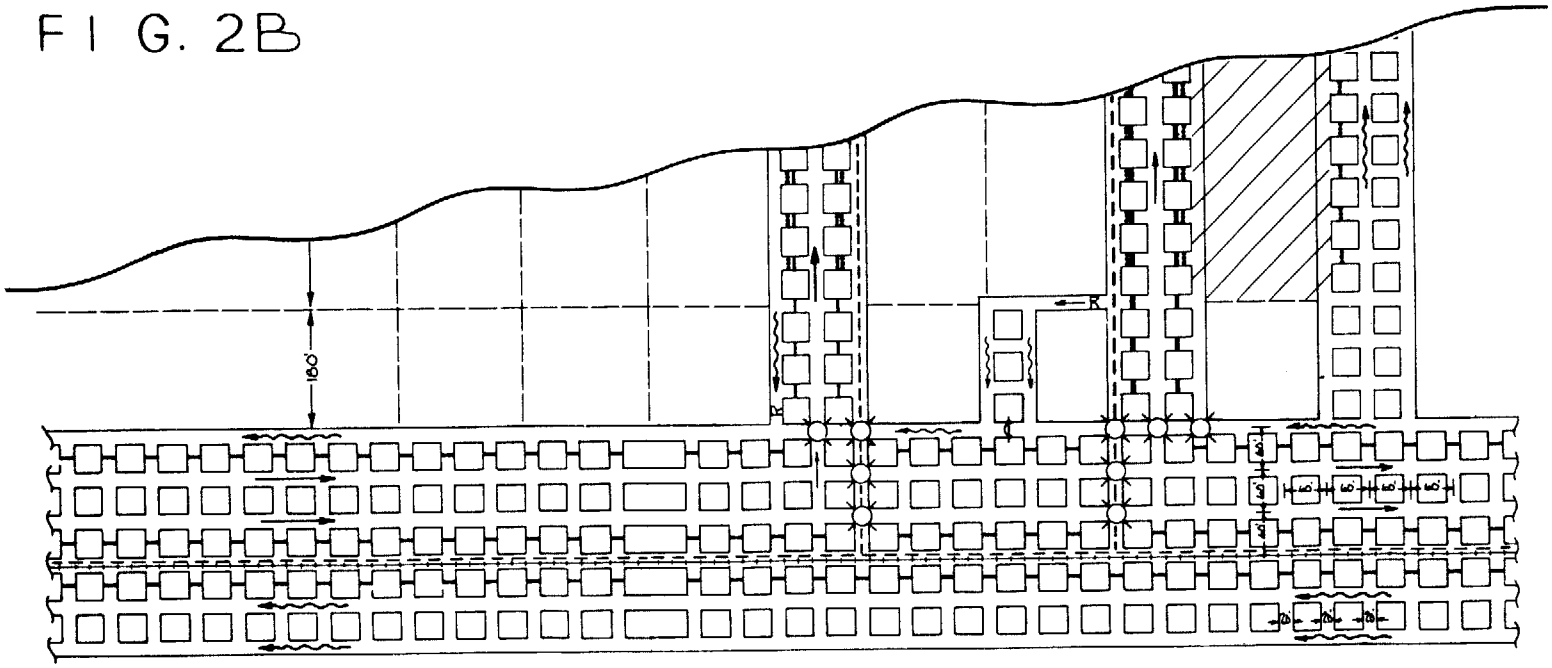
160'
3'
3'
3

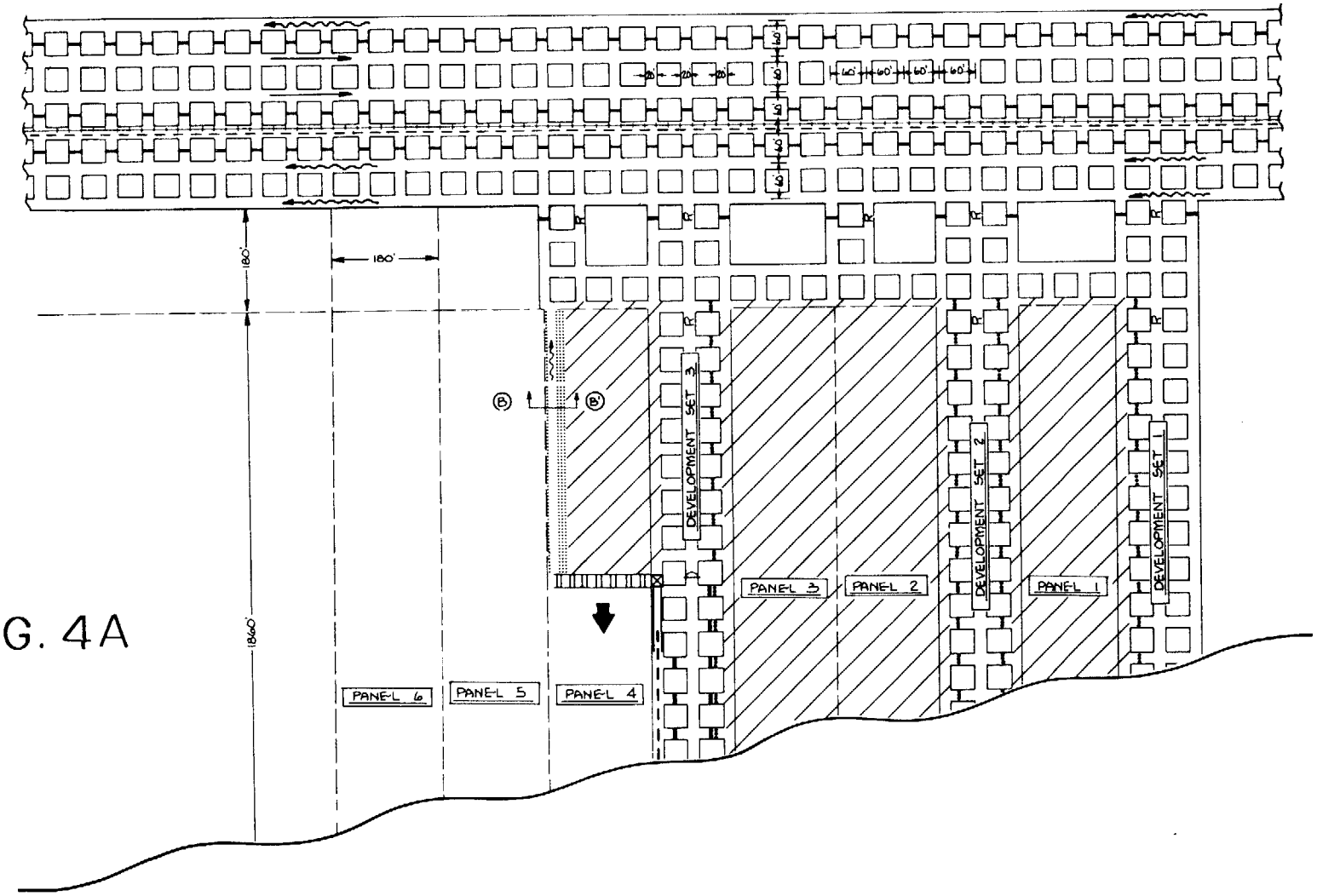
DEVELOPMENT SET 1
DEVELOPMENT SET 2
DEVELOPMENT SET 3
PANEL 1
PANEL 2
PANEL 3
PANEL 4
PANEL 5
PANEL 6
180'
180'
180'
60'
60'
60

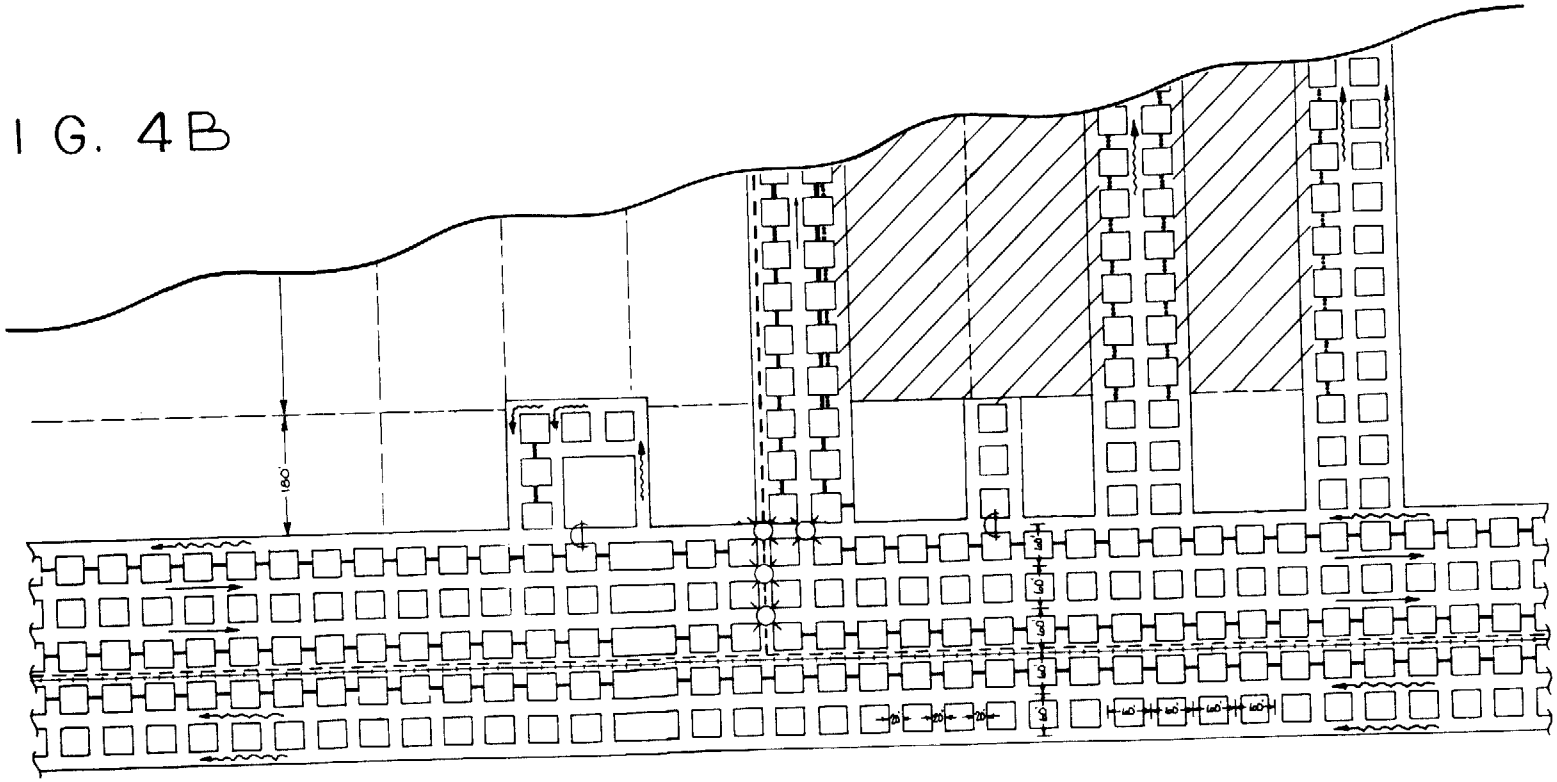
160'
5'
5'
5

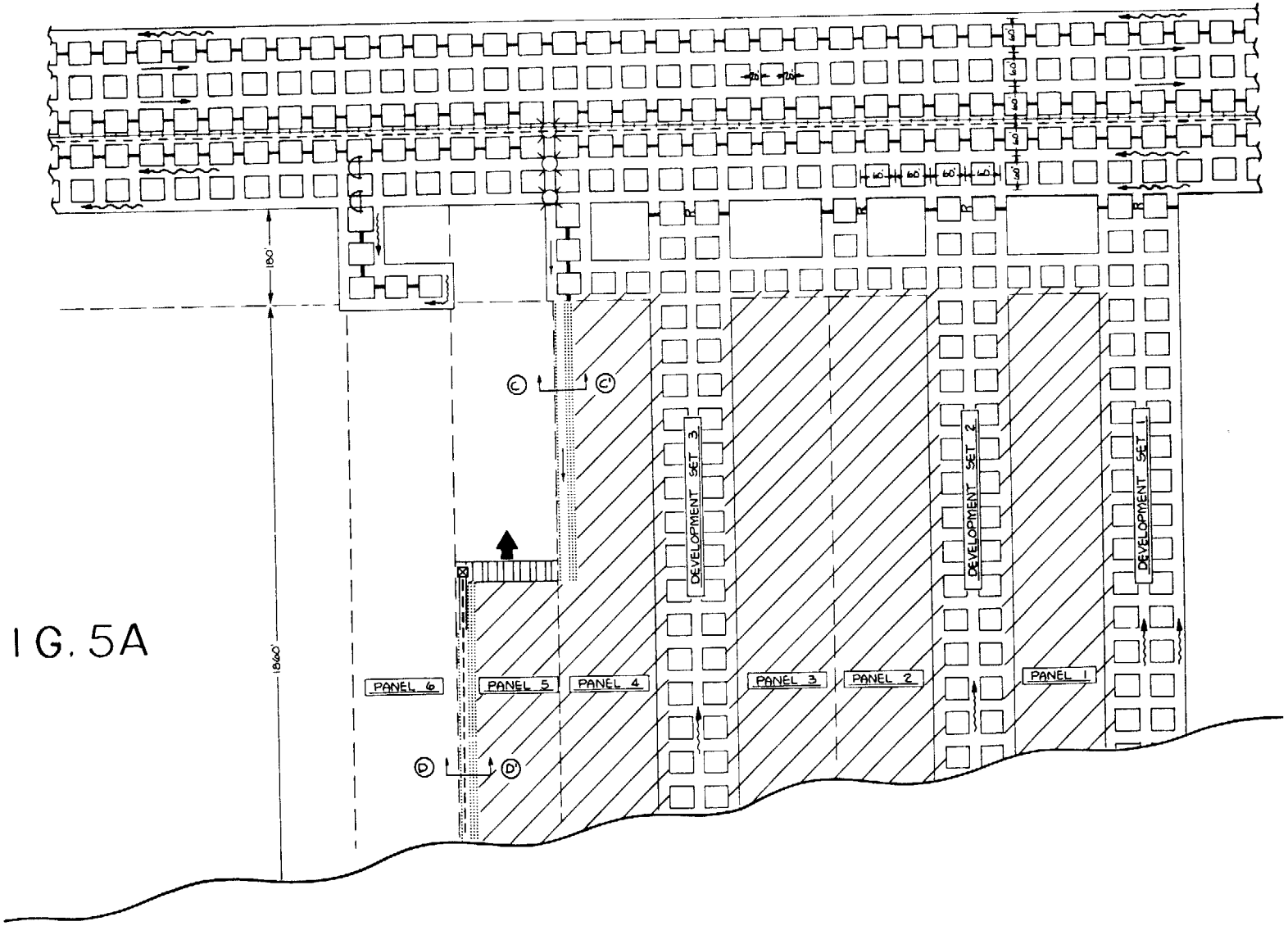
DEVELOPMENT SET 1
DEVELOPMENT SET 2
DEVELOPMENT SET 3
PANEL 1
PANEL 2
PANEL 3
PANEL 4
PANEL 5
PANEL 6
C
C
D
D
60'
60'
60'

MINING METHOD AND APPARATUS

BACKGROUND OF THE INVENTION

This invention relates to the field of mining in general, and to coal-mining in particular.

More specifically, the invention relates to a method of and to an apparatus for mining of coal and of other minerals which are mined in a similar manner as coal.

The tightening situation with respect to the availability of crude oil for fuel and petrochemical uses, is increasingly focussing attention on coal as an alternative. And indeed, the use of coal as a substitute for oil holds great promise. The major bottleneck in the development of unprecedented numbers of applications for coal resides not in technology for the conversion of coal into liquid fuels and petrochemicals; it resides in the technology of extraction.

Extraction speed is comparatively low when considering the huge demand that will be facing the industry in the near future.

Percentage of recovery is also relatively low, on the order of only about 65–75%, which means that between about 25–35% of all mineable coal has heretofore been written off as non-extractable and thus lost forever. This represents a loss of natural resources which is not only intolerable in view of the energy problems confronting the United States, but is also avoidable as e.g., the West German experience has shown, where extraction—albeit under different conditions—amounts to about 95% of the available coal.

A further deterrent to high-volume coal use heretofore has been the rather high extraction cost. Although in the face of steadily rising oil prices the question of extraction economy is no longer as pressing as before, it is still desirable to be able to reduce extraction costs.

And finally, but certainly not lastly, there has been heretofore always been a very significant physical and health hazard inherent in being a coal miner. Conditions below ground do not contribute to making the mining of coal one of the more sought-after occupations. An interesting fact is that the majority of underground mining accidents happen in the process of providing support for the roof within 30 feet of the solid mine face, a problem which will be overcome by the present invention.

All of this will have to be changed if the mining industry is to be able to live up to the national hopes placed in it as a replacement for the suppliers of oil.

SUMMARY OF THE INVENTION

Accordingly, it is a general object of the invention to provide such changes and improvements.

One aim of the present invention is to propose a simplified system which will be able to operate under provisions of the presently existing U.S. Mine Laws, but will in effect introduce basic ingredients to improve the health and safety of the American coal miner.

In order to simplify the explanations herein, the use of the inherited European terminology "Wall" will be elimited hereinafter, because the new system will not be restricted by the length of the coal face to be mined, but will be governed by other factors such as methane liberation, oil and gas well density, or various surface restraints.

The new system according to the invention is intended to eliminate the coal lost that is required in the prior art for roof support in the head entry block and, instead, to introduce a compartmentalized concrete construction which is designed to comply with the Federal Mine Law and to be made of high strength, quick set material, sufficient to support the roof permanently at the same time as the face advances. This is made possible because present technology has advanced to where the quick-set and high strength concrete materials will set up to standard construction specifications in one hour and then cure to three times this figure in one week.

The system according to the invention affords the opportunity to move all personnel by main line transportation under permanent roof supports or under hydraulic powered movable roof supports for protection.

The invention, therefore, will eliminate the continuous miner, shuttle car, roof drill, face drill, loader, cutter, and practically all types of underground existing mining equipment known today, which is expensive to purchase, expensive to maintain, and difficult to train personnel to operate and maintain the equipment. In effect, the invention is able to reduce the hazardous occupation of a coal miner to the relatively safer occupation of a construction worker.

The invention will afford substantially 100% extraction of coal. Moreover, it offers an opportunity to drain, in the process of mining, methane gas which in the prior art is customarily wasted as a natural energy source, thus contributing to improved and safer operation (less methane—fewer chances of explosion) and recovering the methane as a saleable energy source. Coal pillars, which heretofore had to be left behind to support the roof, are no longer needed. This not only allows the extraction of the coal that was previously lost in these left-behind pillars. Such coal pillars generally contribute to adverse roof conditions during subsequent mining operations, because they tend to bring about geologic weight shifting due to a fulcrum effect, and this in turn results in subsidence. These problems are therefore overcome by elimination of the coal pillars.

The invention is, in practice, intended to operate as follows:

A production machine will cut coal across a face of any desired width. Coal will be loaded onto a conveyor of ample capacity and moved across the face to an intermediate conveyor which feeds coal at a uniform rate unto another main line conveyor for delivery to the surface.

A set of hydraulically powered roof supports will be installed completely across the desired face length for roof control above the mining machine and to protect the personnel used to operate and move the roof supports. Both sets of equipment controls will use the latest in remote and automatic sequence design; this will not replace the people entirely because visual inspection or supervision will be required to monitor the production operations. All operating and construction personnel will be protected from exposed roof under a heavy steel umbrella of hydraulic shield supports.

In the head and tail compartments, duplicate roof supports will be installed in piggy-back fashion behind the end face units to enable workers to install concrete posts and ancillary construction to accomplish the three proposed compartments on the head end and a single escape way on the tail end. The concrete posts would be installed on centers determined by the mine roof control permit which every mine must have to comply with Federal Law. The hydraulic powered roof supports would protect the workers during the construction and curing time necessary and most important, before the strata above begins to yield.

Lattice (e.g., wiremesh) work if required for additional roof support strength and concrete ceiling, may be installed to eliminate rock weathering and subsequent maintenance.

Rib (sidewall) sealing by applying thin coatings of quick setting concrete to the sidewalls in lieu of the heretofore prescribed rock dust cover (65% non-combustible material to eliminate coal ignition, as per Federal regulations), would reduce methane liberation and afford the opportunity, after the face advances, to drill and tap the solid coal ribs for methane drainage and also permit eventual water infusion to expel residual methane. Quick acting concretes are dangerous to handle; therefore, it is intended to include a pneumatic pipeline system which will afford bulk handling of the mixture to the place of application where it will be combined with water in a closed circuit system. Pneumatic bulk handling of concrete is not new, because it is all handled that way on above-ground construction jobs, but bulk handling of dry ready mixed material with water introduced only at the point of use in a closed circuit system, is considered to be new.

The ventilation system would use one intake with its physical size or area designed to conform with the volume of air actually required to dilute the methane liberation across the solid mine face. The middle compartment would not be positively ventilated to eliminate fire hazards and propagation of a fire if one does start, but air would split at the face end of the head entry with the larger amount moving across the face and the balance split and regulated down the outside return. If methane liberation were at the maximum extreme, two of the compartments could be used as intakes, requiring the tail entry to be increased in size to handle this new increased volume of return air. The former design would be more desirable because in case of a belt head fire, the air could be short circuited and kept away from the work crews.

The tail end and the head end construction job would be accomplished while mining is progressing. Concrete post supports would be installed on cycle under the protection of the supporting shield. Plastic or canvas curtains would be used as the walls for the ventilating compartment. Concrete sealant would be applied to the canvas duct as well as the coal rib, eliminating the requirement for rock dust.

The invention also proposes special mining machinery for mining coal during movement of the machinery along the face in either direction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIGS. 1*a* and 1*b* a fragmentary diagrammatic plan view, illustrating the inventive method on the basis of a six-panel coal extraction plan, and showing working of the first panel;

FIGS. 2*a* and 2*b* show a view similar to FIG. 1 but showing working of the second panel and construction of the return air escapeway;

FIGS. 4*a* and 4*b* working of the fourth panel; and again construction of the return air escapeway;

FIGS. 5*a* and 5*b* show working of the fifth panel in which complete extraction of the coal is accomplished without using any coal pillars for support of the roof;

DESCRIPTION OF THE PREFERRED EMBODIMENTS

The Method

Figure 1A:
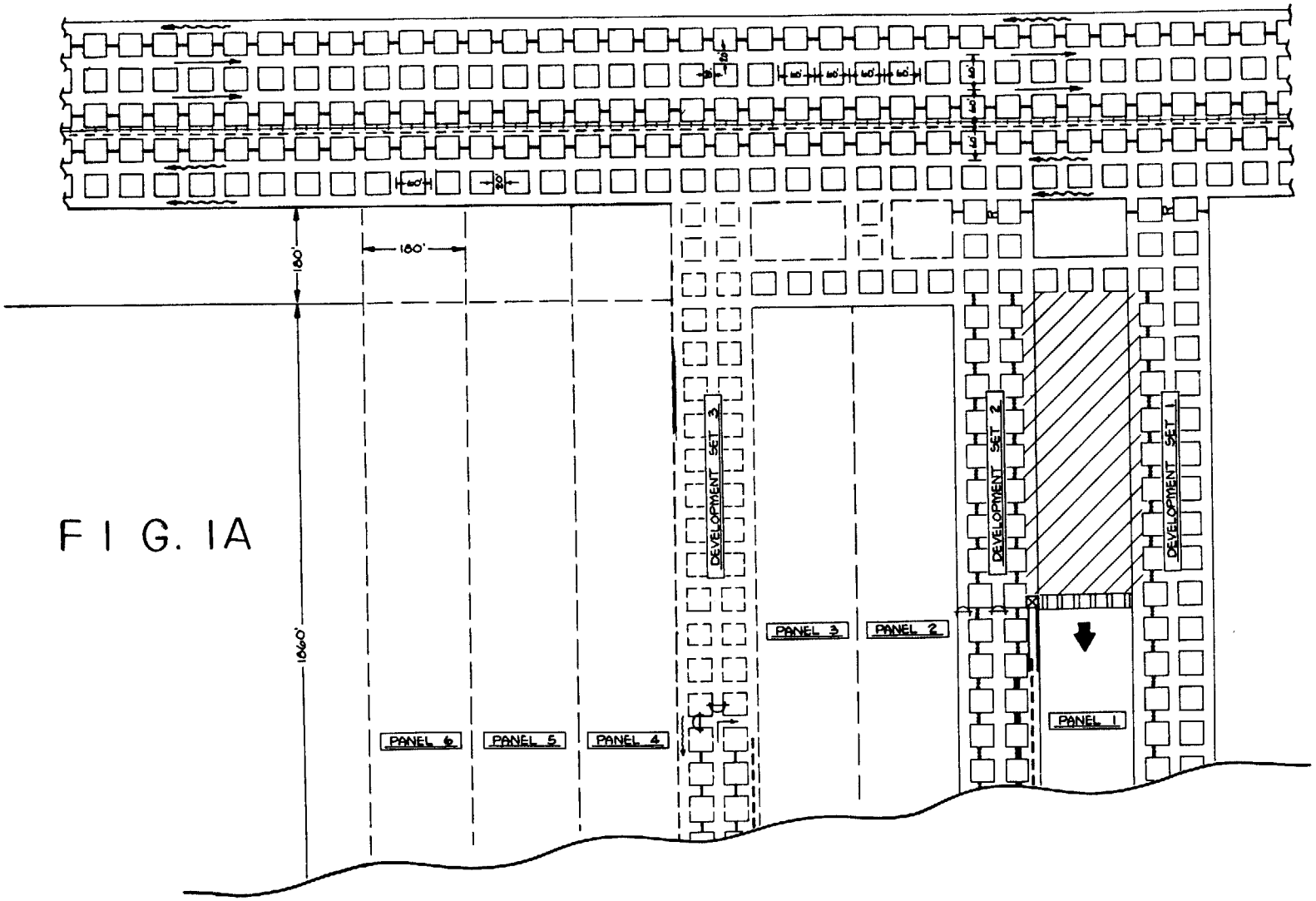
Figure 1C:
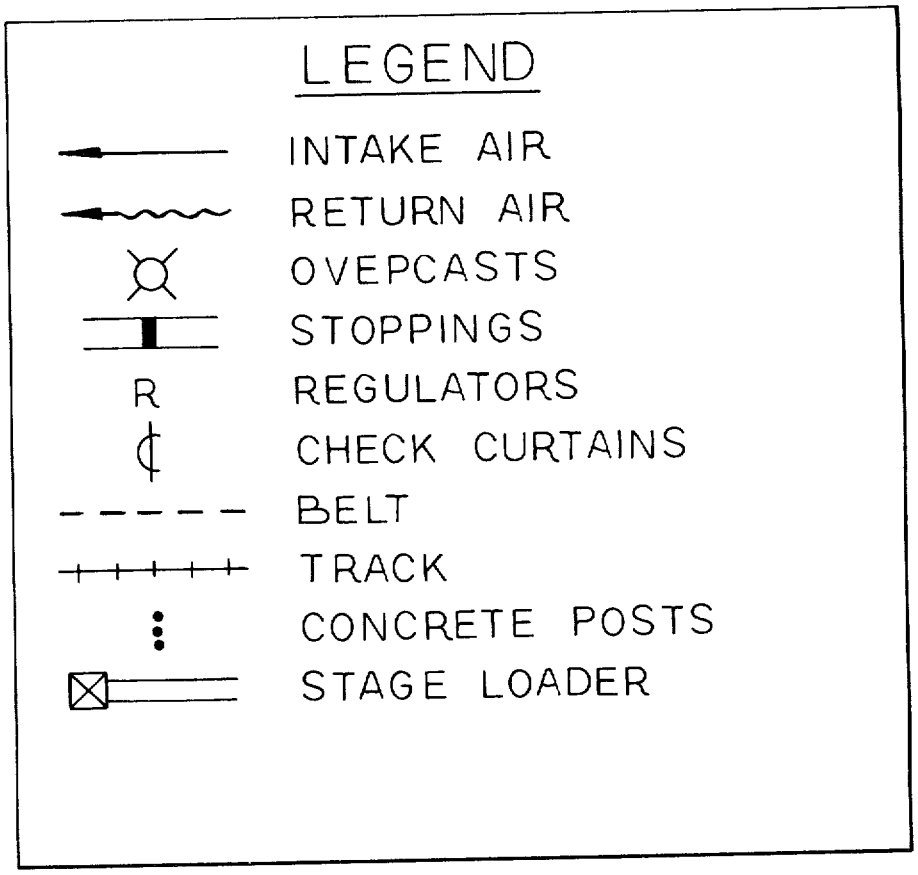
FIG. 1*c* is a legend of the symbols used in FIGS. 1–6.
Figure 2A:
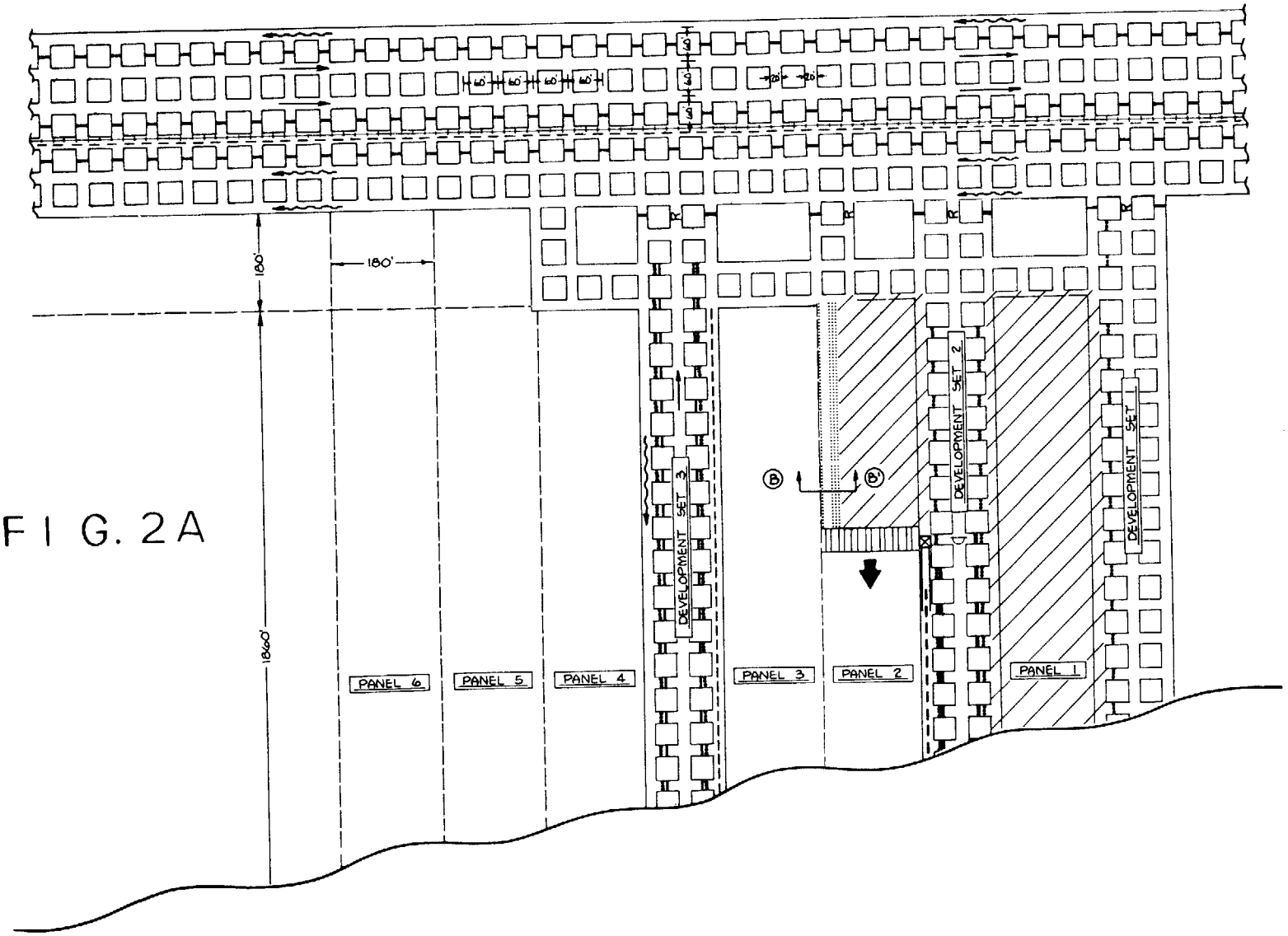
Figure 3A:
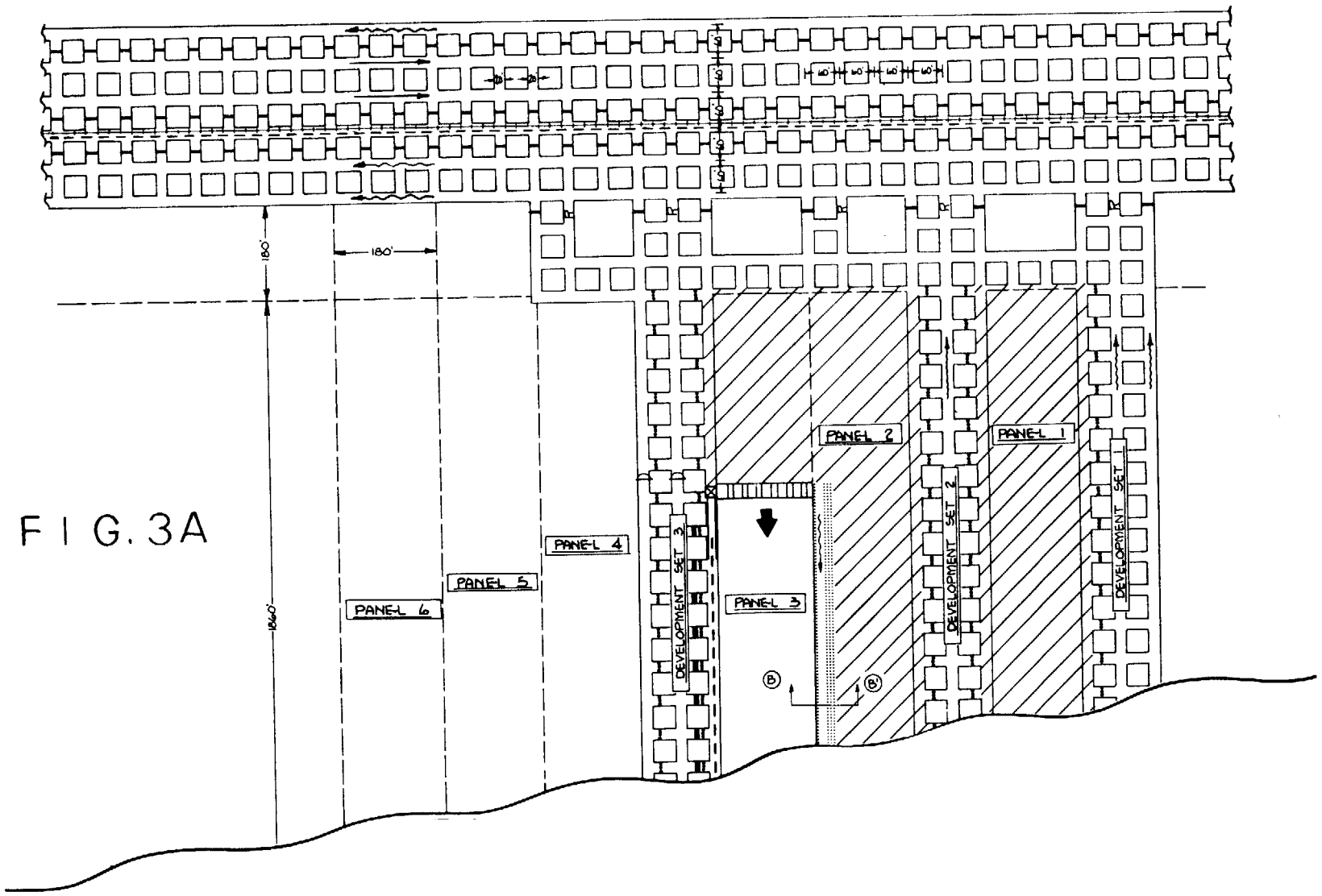
FIGS. 3*a* and 3*b* are also similar to FIG. 1 but shows working of the third panel using the return air escapeway on the next panel.
Figure 3B:
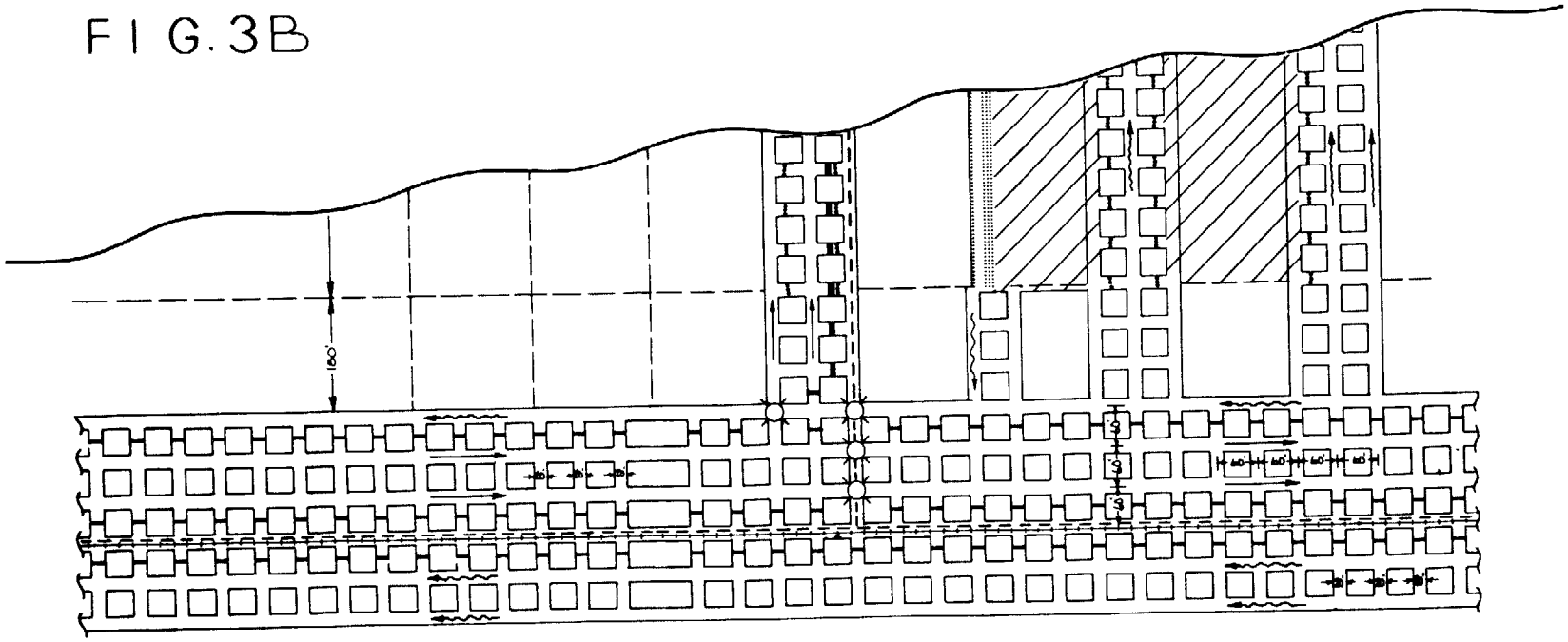
Figure 5B:
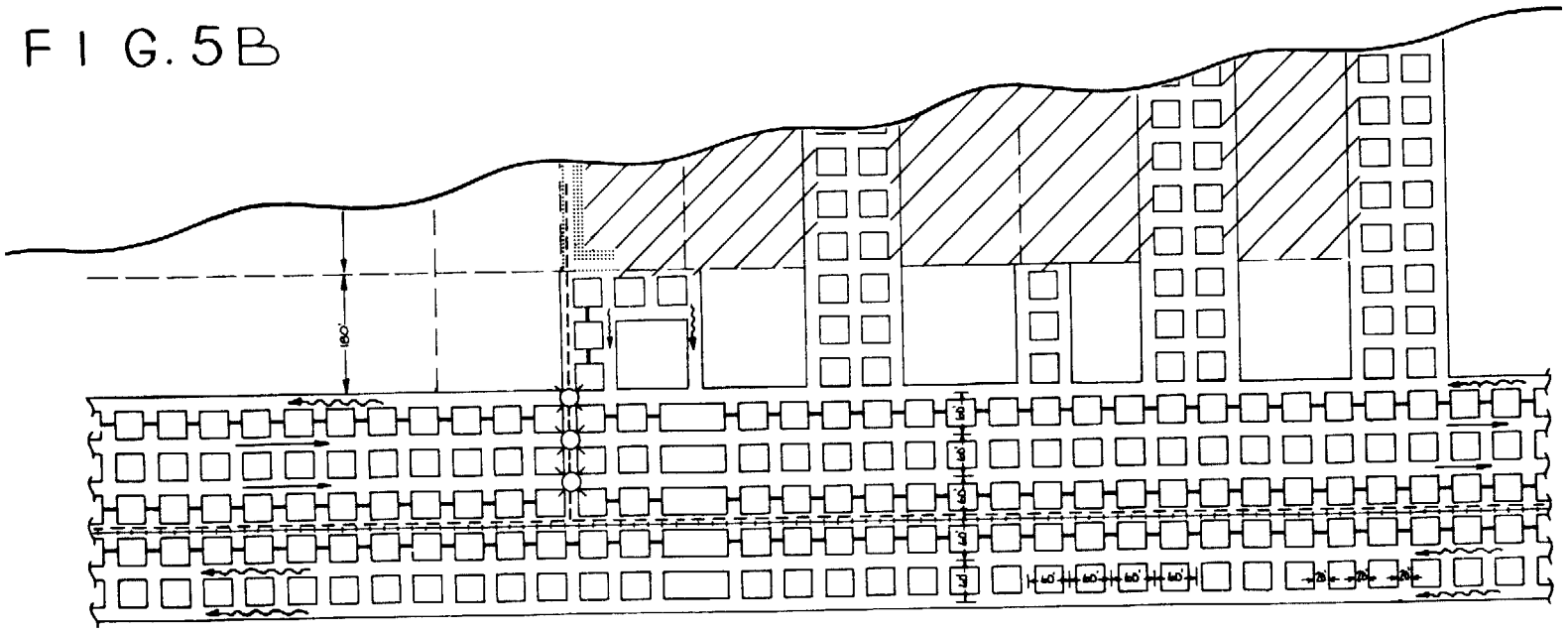

In the following the method according to the invention will first be discussed, with reference to FIGS. 1A–6B of the drawing. For the sake of explanation it will be assumed that a six-panel coal extraction is planned, the panels being numbered 1–6 and extending between two mains spaced from each other at 2200 feet. This includes 180 ft. wide barrier pillars along each main, so that the net length of each panel is 1860 feet.

As FIGS. 1A–6B show, the initial panel development consists of three entry systems with pillars on 60 ft. centers. Two sets of entries are driven for the first and second panel. One additional set of development entries services panels 3 and 4. Panels 5 and 6 will not require panel development entries; these panels will develop their own entry gates during mining, whereby roof exposure time between development and retreat cycles, as applied in present mining systems, is eliminated. Long roof exposure between development and retreat cycle, as applied in present mining procedures, can cause scaling of the immediate roof and complicate the operations. The invention, by eliminating roof exposure between the development and retreat cycles, removes this hazard. In the prior art, and in accordance with Federal regulations, all such entries must be roof-bolted whereas the present invention eliminates the need for such roof-bolting entirely, as well as the construction of stoppings which was heretofore required between coal blocks for ventilation purposes.

Other advantages of eliminating development entries are operating concentration and reduction in rock dust requirements. Present systems, such as longwalls and shortwalls, require as many as four operating sections for development and mining with resulting decentralized production, more complicated ventilation and increased rock dust use.

The system according to the invention, by contrast, is concentrated, easy to ventilate and supervise, with limited roof exposure and reduced rock dust use for rib sealing purposes without the need for roof bolting.

Panel No. 1 is retreated between two sets of prior developed panel entries. The panel conveyor is installed in the entry adjacent to the panel in entry set No. 2. The two other entries in set No. 2 are air intakes. All three entries in set No. 1 are returns for the first panel. Two of these entries remain as bleeders during subsequent mining of panels 2 to 6.

The rock dusk bulk handling system currently available in mines as per Federal Regulations can be used to transport raw materials such as dry concrete to the point of preparation and installation.

Panel No. 2 utilizes entry set No. 2 as headgate and develops its own tailgate. The headgate entry adjacent to the panel accommodates stage loader and conveyor, while the center entry is an air intake. Tailgate entries constitute the air returns and the return air escapeways, as per Federal regulations.

Four face supports at the tailgate are "walk through" supports. The conventional lemniscate arrangement is replaced by an extensible roof protection plate with support cylinder. The shape of the roof extension plate permits the placement of concrete posts and steel straps with personnel always positioned under a protective roof.

Preliminary post patterns may be set 4 ft. on centers for three post lines against the gob. One additional post line may be set 2 ft. from the coal rib, 10 ft. from the nearest post of the three gob lines. The 10 ft. span between posts may be protected by a steel strap.

Panel No. 3 uses entry set No. 3 as headgate. The conveyor is in the entry adjacent to the panel, with the two other entries as intakes.

The previously developed tailgate from panel No. 2 can be used as tailgate for panel No. 3. Since concrete posts for the tailgate will be set during development of panel No. 2, no additional concrete posts are necessary for panel No. 3.

Concrete posts must hold the tailgate open in front of the face, but must cave after panel extraction in order to relieve overriding pressure from adjacent panels. Since there are no chain pillars between panels No. 2 and No. 3, wide spans in excess of $2\times180$ ft. $=360$ ft. can be expected to induce controlled caving conditions in panels No. 2 and No. 3. Panel No. 4 will be mined in the same way as the previously mined panel No. 2.

Panel No. 5 will be a "Z" operation, so called because the advancing headgate, the face and the reatreating tailgate together form a Z pattern. Panel No. 5 utilizes the same tailgate as panel No. 4, expect that the tailgate of panel No. 4 is on return air, while the same tailgate becomes an air intake for panel No. 5. The reason for the air intake through the tailgate is the desire to have air returns parallel to the conveyor; or parallel to the headgate which is the case in panel No. 5. Requirements for a minor air intake volume for the belt conveyor are supplied from the lower mains by a regulator. The same intake air joins the return air parallel to the conveyor. Panel No. 6 will also be a "Z" operation, and utilizes the same headgate as panel No. 5. The tailgate is driven behind the face for air intake. Each set of subsequent panels repeats the cycle established in panels No. 5 and No. 6.

Present mining systems, such as longwall and shortwall systems, use chain pillars between adjacent panels. Chain pillars produce stresses in overlying strata and could cause delayed caving and uncontrolled delayed subsidence and, of course, the coal represented by these pillars can never be fully extracted. The system according to the invention, on the other hand, extracts 100% of the coal and controls the associated subsidence. Chain pillars are eliminated and barrier pillars along the mains are recovered during retreat, obsoleting the conventional, expensive wood constructions (e.g., cribs) with the undesired yielding characteristics (to overhead load) and flammability.

One of the most important aspects of the invention is the setting of concrete posts or props for roof control purposes. The use of these non-yielding posts affords an otherwise unattainable degree of roof control at economically highly favorable costs.

The Apparatus

Figure 6A:
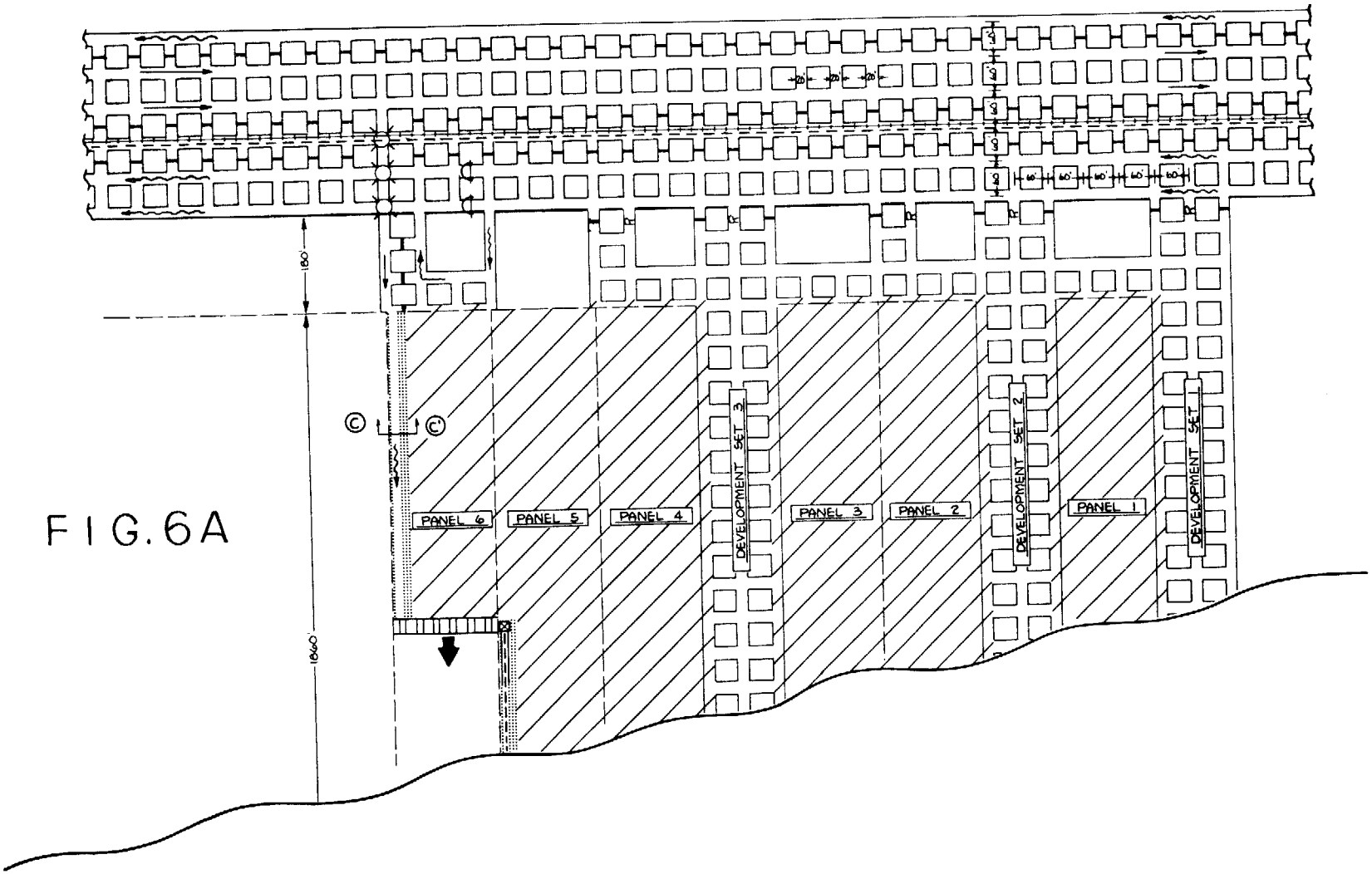
FIGS. 6*a* and 6*b* working of the six panel similar to the fifth panel.
Figure 6B:
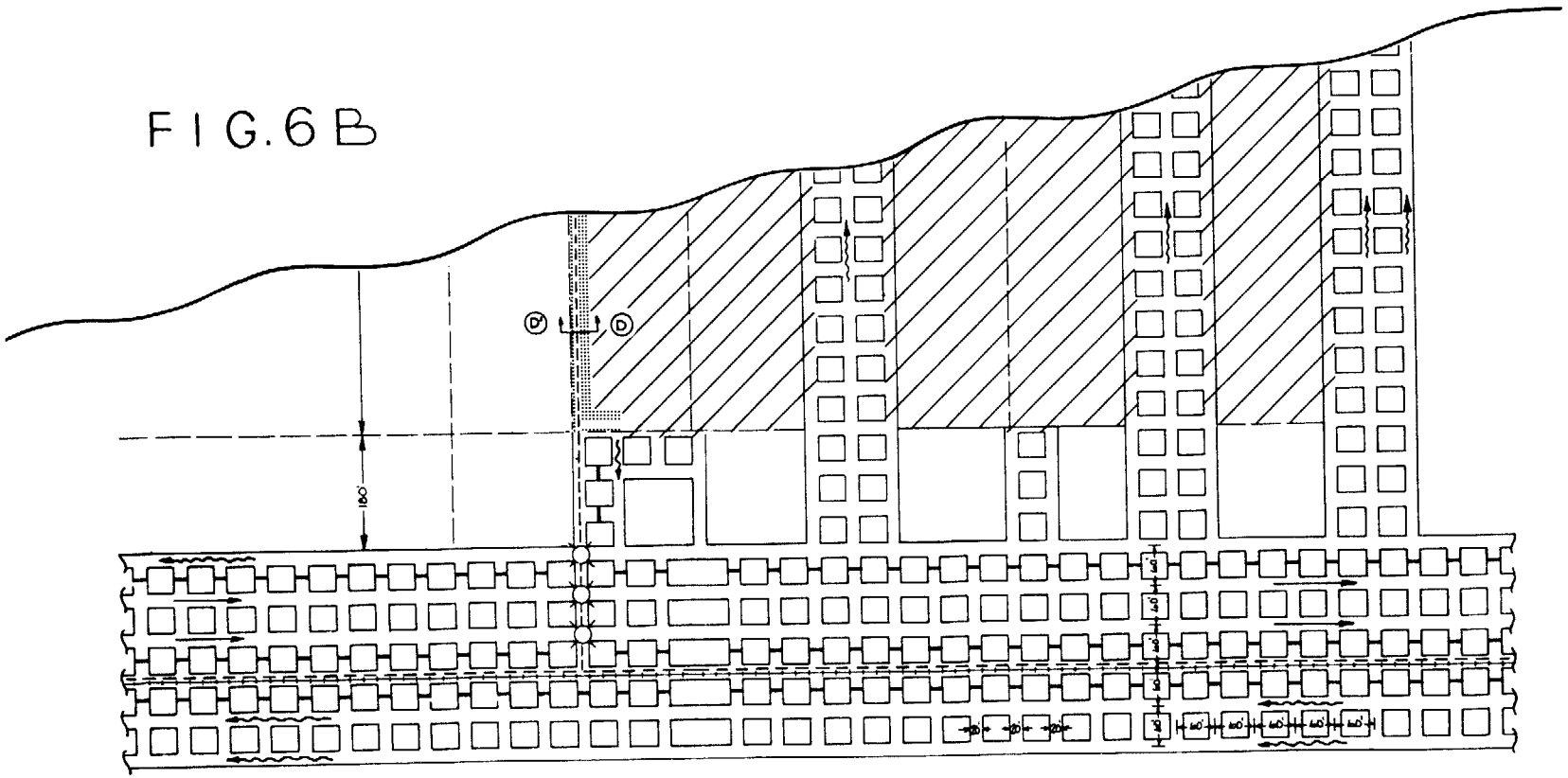
Figure 7:
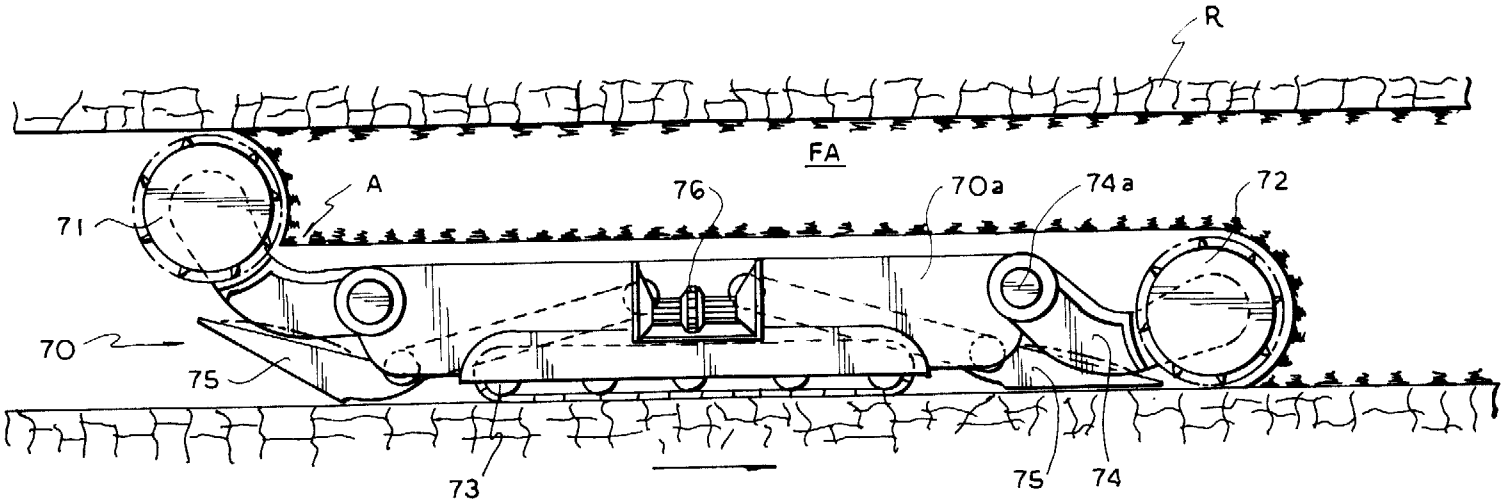
FIG. 7 is a somewhat diagrammatic partly sectioned side view, illustrating a mining machine in accordance with the invention.
Figure 8:
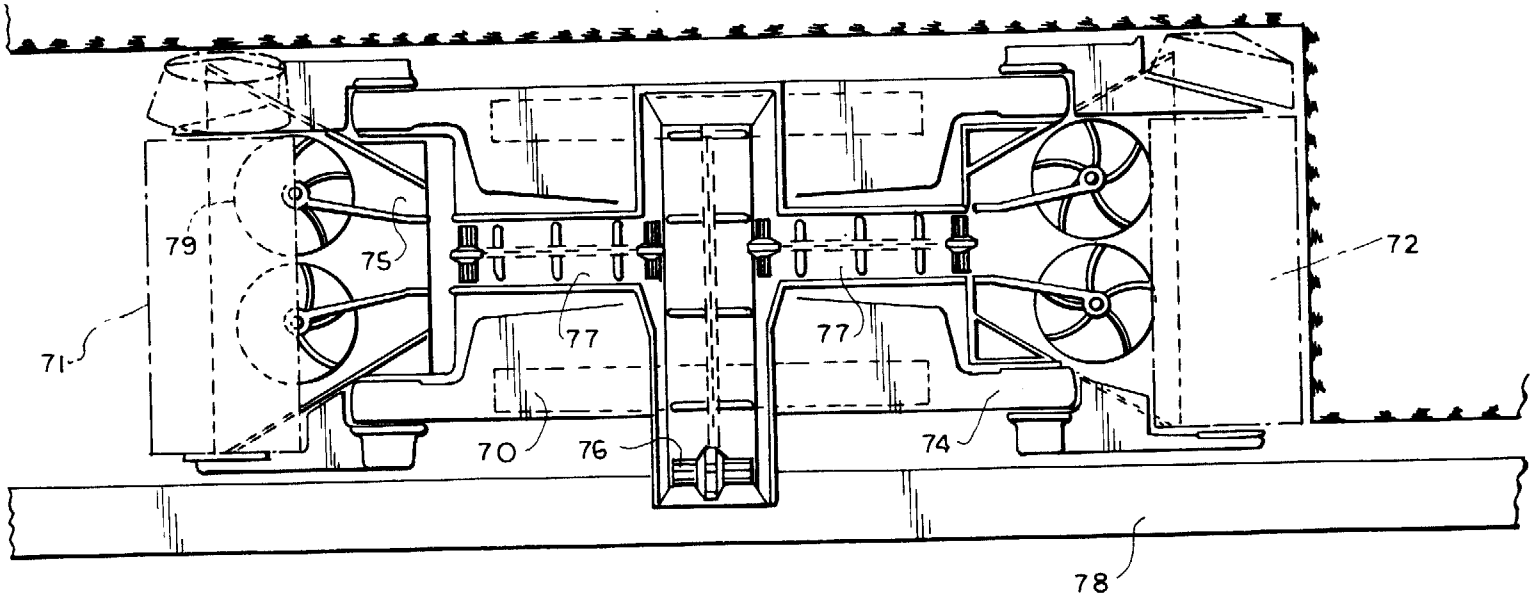
FIG. 8 is a top plan view of FIG. 7.

As shown in FIGS. 6 and 7, a coal-mining machine 70 removes coal from the face FA from the roof R to the floor FL. The machine moves along the face FA and removes coal during movement in either direction. In FIGS. 1A–2B it is assumed that the machine is moving in the direction of the illustrated arrow as it removes coal with the aid of its two coal-removing tools 71, 72, here shown as drums 71, 72 are mounted on pivot arms 74 which are pivoted at 74*a* to the machine frame or body 70*a*.

The machine 1 may either be pulled along the face on the floor FL (or on a track) by means of appropriate chains and winches or analogous instrumentalities, or—as shown—it may be self-propelled and have its own tramming (haulage) system (e.g., chain-laying tracks and a drive).

The tools 71, 72 need not be picked drums as illustrated, but could be other coal-mining instrumentalities. For example, high-speed high-pressure (to about 1500 bar) water jets could be directed against the coal at the face to dislodge it. If so, the water under pressure may be supplied from the body of the machine 1 via high-pressure pumps and via supply lines accommodated in or on the arms 74. A combination of such water jets and of picks is also highly advantageous. In either case, however, the water will have the additional advantage of limiting the undesirable evolution of dust.

FIGS. 1A–1B shows that the arms 70*a* are curved in upward direction and the pivots 74*a* are positioned as far up in the machine body 70 as possible. The reason for this is the illustrated division of cutting labor between the tool (71 or 72) which is leading in the cutting direction and the tool (72 or 71) which is trailing in that direction. The leading tool (here the drum 72) cuts away bottom coal beginning at the floor FL and sufficiently far up for the machine 70 to be able to move along, whereas the trailing tool (here the drum 71) cuts away the roof coal, i.e., the coal extending from the upper cutting line of the leading tool 72 to the roof R. This complete recovery in a single machine pass is possible only because of the upward curvature of the arms 74; if the arms were straight, rather than curved, they would abut against the roof coal in the region A and would either prevent progress of the machine, or be damaged or destroyed in the course of such progress.

In operation, the machine performs one cutting pass along the face (e.g., in the direction of the arrow) until it reaches the end of the panel (and hence of the face). It then reverses its direction of movement, the tool 72 is raised and the tool 71 lowered (i.e., their previous relationship reversed) and the machine now performs the next cutting pass but in the opposite direction to the previous one. The coal removed from the face is, of course, always conveyed to the head end and to main transportation to the outside; i.e., there is no change in the direction of coal conveyance when the direction of machine movement changes.

A particular advantage of this machine, contrary to the known so-called "continuous miners", is the fact that it removes material during each pass along the face, i.e., in both directions, whereas the prior-art machines remove coal only during their working movement in one direction and must perform their return movement without doing any cutting, which self-evidently leads to loss of productivity.

At opposite ends the machine 70 has loading heads (chutes) 75 which are preferably vertically tiltable and onto which the coal drops when it is removed from the face by the tools 71, 72. The heads 75 may in turn be provided with coal-moving devices, e.g., the illustrated (FIGS. 2A-2B) ribbed transporting spinners (wheels) which turn above the head surfaces and entrain the coal in direction towards short conveyors 77 which in turn transport it to a transverse conveyor 76 that transports the coal to the main panel or face conveyor 78 that extends lengthwise of the panel between the mains, along the face FA. The conveyor 78 is articulated or movable in vertical direction, so that it can accommodate itself to uneven conditions of the floor FL or to different mountings. In horizontal direction, transverse to its elongation, it need only have limited freedom of displacement, since it is advanced as a whole (preferably by hydraulic cylinder-and-piston units) towards the face every time the machine 70 completes a cutting pass. Such conveyors are, incidentally, well known from the art so that a more detailed description of the conveyor 78 and its hydraulic advancing mechanism, is not necessary.

The width of the machine 70 advantageously equals about 50% of the width of known per se continuous miners, and the tools (e.g., drums 71, 72) have an axial length so selected that they project somewhat beyond the sides of the machine 70, to assure that sufficient coal is cut away during each pass so that nothing will hinder the advancement of the machine.

The machine 70 can, of course, be controlled in any desired manner. It may have a control stand or seat for an operator and this may be made to swivel through e.g. 180°, so that the operator can change positions when the cutting direction of the machine is reversed. However, the machine may instead be equipped with known-per-se remote control equipment, or with detectors or sensors which sense a radio (magnetic) cable laid along the face (or a laser beam directed along the face) and move the machine along the cable or beam, so that absolute horizon control, i.e. straightness of its movement is assured. If such a cable or laser-beam control is used, then the sensors/dectors on the machine are preferably mounted on that side of the machine which is directed away from the coal face.

Figure 9:
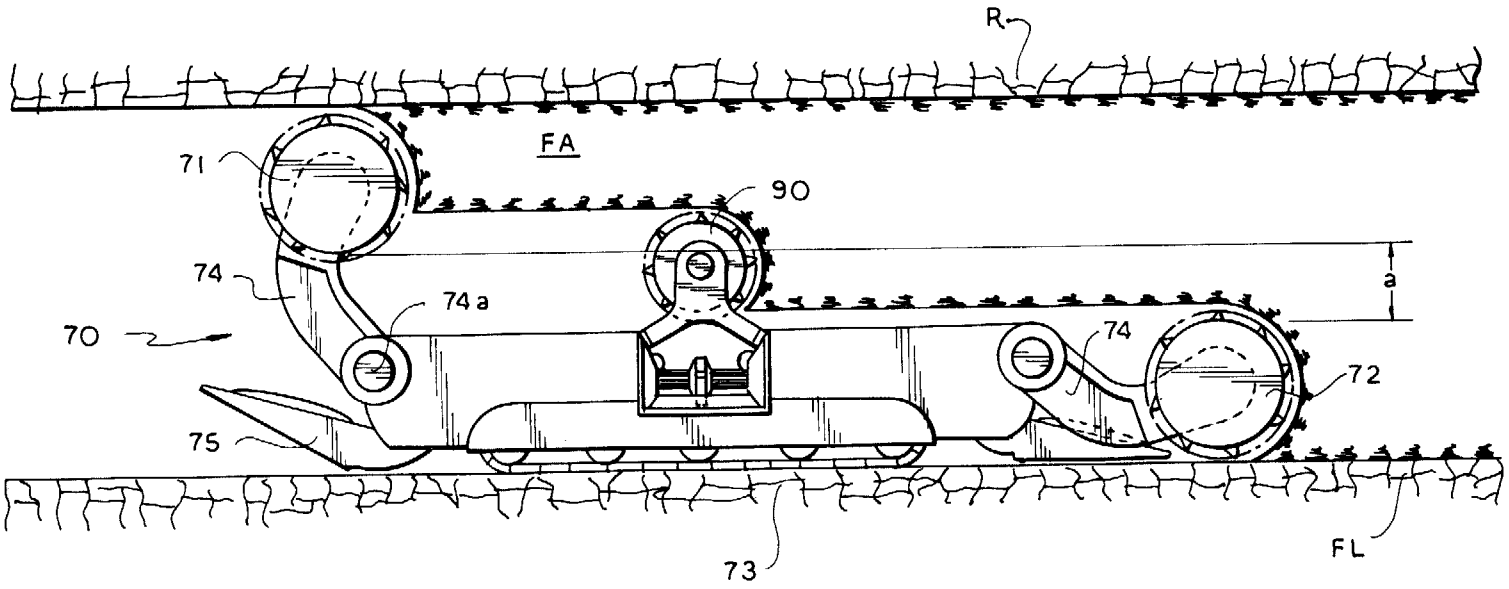
FIG. 9 is a view similar to that in FIG. 7 but of a different embodiment of the mining machine.

In some instances the height of the coal seam (i.e., the distance from R to FL) may be greater than the combined diameters of the drums 71, 72. In that case, a strip of coal having the thickness D (FIG. 9) would remain during each mining pass of the machine. To avoid this, the embodiment in FIG. 9 (which in all other respects corresponds to and uses the same reference numerals as the embodiment in FIG. 7) proposes to mount a third drum 90 (again provided e.g., with picks) on the machine 70, in such a position that it will be positioned directly above the conveyor 76 and will remove the coal strip D.

In all embodiments the drums 71, 72, 90 will be rotated in such a sense that the coal they remove will drop primarily onto the heads 75. In other words: as little coal as possible should drop onto the floor FL behind the advancing machine 70. This can be facilitated by providing the heads with telescopable extensions which can extend underneath the respective drum 71, 72 to reliably prevent the coal from dropping onto the floor. The drum may be driven in any known-per-se manner, by drives installed within the drums themselves or else in the machine. In the latter case, step-down-transmissions are preferably installed in the arms 4.

Figure 10:
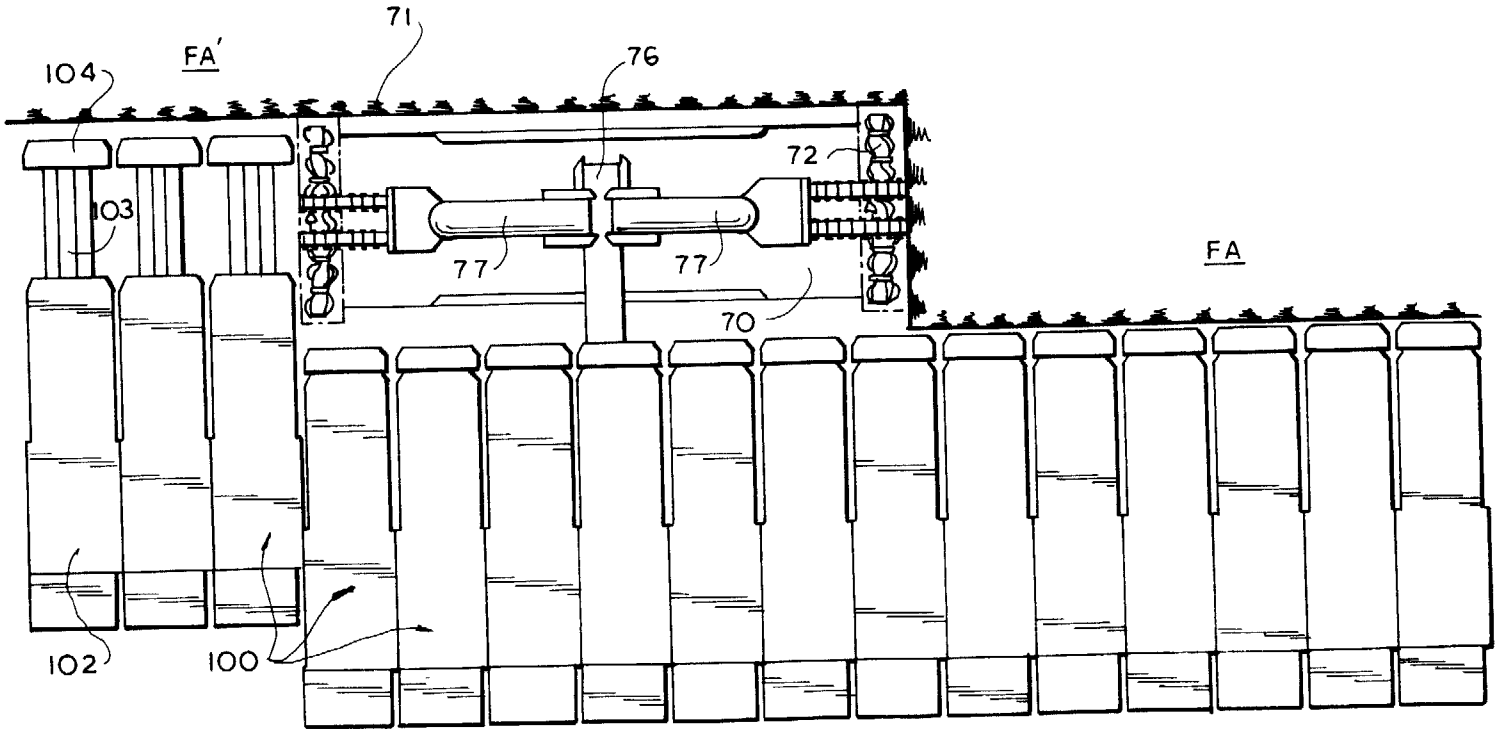
FIG. 10 is a diagrammatic top plan view of FIG. 7, also showing protective roof shields.
Figure 11:
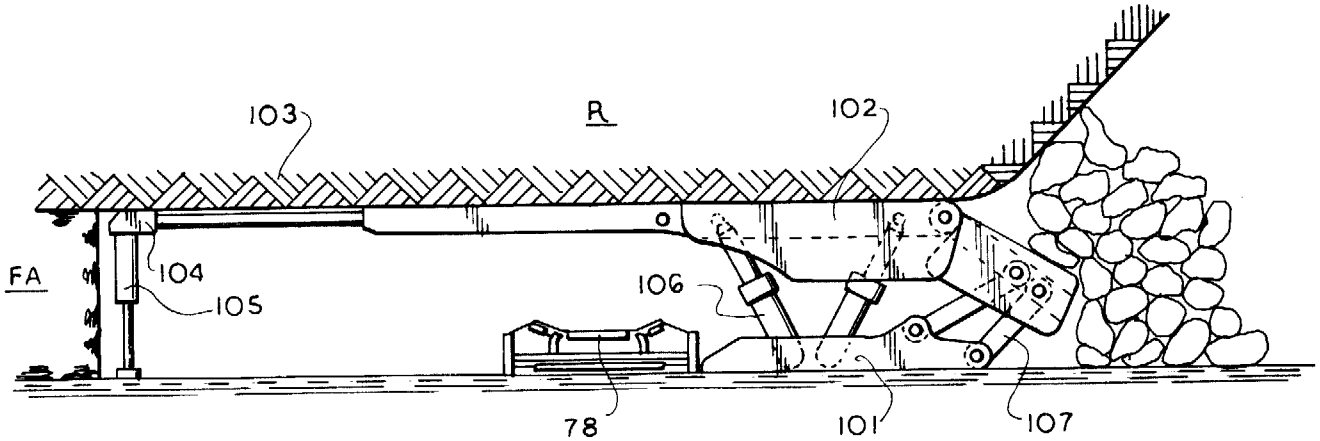
FIG. 11 is a diagrammatic side view, partly sectioned, showing one of the roof shields of FIG. 9.

The machine 70 and the conveyor 78 are protected by a series of roof supports 100 of a type known per se, for example type "Heintzmann Shield Support P 1737" available from Bochumer Eisenhuette Heintzmann GmbH & Co., Bochum, Federal Republic of Germany. These supports are arranged in a row along the face (FIG. 10) and, as shown in FIG. 11, are each composed of a skid or base 101, a roof support shield 102, a telescoping shield extension having a front end portion 104, and a double-acting telescopic cylinder-and-piston prop 105 which is hinged to the position 104 so that it can be pivoted to upright position (FIG. 11) for roof support at the immediate coal face. The shield 102 is mounted on and supported by (as well as height-adjustable relative to) the skid or base 101 via a plurality (e.g., four) telescopic props 106; it is also pivotally linked to skid 101 via links 107. Operation of the hydraulic components is effected by appropriate controls known per se (e.g., from the Heintzmann shield).

As the machine 70 advances in its coal cutting pass along the face FA (towards the right in FIG. 10) it leaves open space behind it. Immediately or almost immediately after the machine passes a respective shield support 100, the same is advanced from its previous position, i.e., moved towards the newly created coal face FA' by known-per-se hydraulic devices. This is shown in FIG. 10 for the three left-hand supports 100. The extension is telescoped out and the support prop 105 thereof pivoted downward and hydraulically set between the floor FL and the roof R, so as to offer support immediately adjacent the new face FA'.

A comparison of FIGS. 10 and 11 shows that all personnel, the conveyor 78 and the equipment adjacent the face will at all times be under the protection of a solid steel "umbrella" constituted by the supports 100. Virtually the only roof portion which is not supported at all times is that portion of the roof R above the newly cut portions of the coal seam; as FIG. 10 shows, this amounts at any one moment to a roof section having substantially the same length and width as the machine 70 itself, plus a section corresponding to the dimension (in direction lengthwise of the face) of a respective shield 100.

It is important to note that the hydraulic prop 105 of each support 100 can remain in its supporting position until shortly before it is reached by the machine 70 as the same performs the next cutting pass in the opposite direction. This assures support of the roof R immediately adjacent the face FA and FA' during almost the complete operating time and creates a condition of safety not heretofore attainable.

The face FA (FIG. 11) extends crosswise of a panel from which coal is being extracted; therefore, the direction in which the face recedes as coal is removed, is lengthwise of the panel. At opposite ends of the face, i.e., where the machine 70 ends its cutting pass and reverses direction for the next cutting pass, the head gate (road) and tail gate (road) are developed which extend lengthwise of the panel. Along these roads it is customary to leave chain pillars in place for the purpose of supporting the roof.

The present invention allows the elimination of chain pillars (and hence the recovery of coal which forms these pillars and is otherwise lost to use) by the use of non-yielding concrete posts which are erected in situ with quick-setting cement.

Such cement is already known and commercially available (e.g., as "VHE Cement" from the United States Gypsum Company). This type of cement sets within 3-5 minutes of mixing, so that cement filling into a casting form for a post will be shape-retaining and self-supporting within 3-5 minutes, at which time the casting form can be removed. The post then rapidly reaches full supporting strength. The concrete may be mixed with standard aggregate (e.g., sand) or it may be reinforced with steel fibers as per Bureau of Mines Report of Investigations 1980, Number RI 8412.

Setting of these posts in situ can be effected via preferably self-propelled vehicles of the type disclosed in the copening application of Klaus Spies, entitled "Apparatus for Erecting Mine Roof Support Columns", Ser. No. 236,301. Such vehicles may carry a pair of telescopic casting forms of light-weight material, each mounted on a manipulator arm of the vehicle and each of the type to be pivoted open and shut. When placed in upright position between the roof and the floor, these forms are telescoped apart until each of them bears upon the roof and the floor. Then, one or more pumps on the vehicle pump cement, water and, if desired, aggregate (e.g., sand) towards the respective form. The materials become mixed just before they enter the form. The resulting slurry sets up to self-supporting state within 3-5 minutes, whereupon the forms can be removed and used to produce the next posts. While one form is thus used to produce a post, the other form can be erected and made ready, so that no time is lost. The arms and forms can be so mounted on the vehicle that the posts are alternately set left and right of the vehicle, so that the vehicle produces two parallel but transversely spaced rows of the concrete posts.

However, it would also be possible to utilize a pneumatic pipe line system (already available in most mines to transport rock dust) for the transportation of cement and aggregate to the point of use, where it would then merely be necessary to add water, mix and introduce the resulting slurry quickly into the already erected casting forms.

Moreover, spray equipment may be provided for spraying a coating of this slurry onto the ribs to seal the same against methane liberation, thereby eliminating the need for the currently required frequent application of rock dust coatings to the ribs. The methane can then be recovered for later use by drilling appropriate drainage holes. If these are so positioned that they will eventually be reached as the mine face advances, then water under pressure can be injected through respective ones of these holes into the coal about to be mined, so as to suppress or at least reduce the liberation of coal dust during mining and so cause the migration of residual methane gas in the rock to the next active gas hole from which it can then escape to be collected.

An important aspect of the invention resides in the fact that the combination of mechanical roof supports immediately adjacent to the face, and of the concrete roof support posts, provides the roof with support which is applied so rapidly after the coal removal that the traditionally needed roof control method of installing roof bolting, becomes to all intents and purposes superfluous. There may be an exceptional instance where this is still advisable, but on a production basis the need for roof bolting is eliminated by the present invention.

The arrangement of the concrete posts in spaced parallel rows can be utilized to eliminate the heretofore indispensible mining of rock (not coal) in order to produce clearance for movement of the mined coal and for moving the required high volumes of ventilating air. By arrangeing (e.g., hanging) sheet material lengths along the rows of posts, the area supported by the posts can be subdivided into compartmentalized coal-traffic and air passageways. The sheet material is preferably an air-impermeable material, e.g., a synthetic plastic foil of requisite weight and strength. However, canvas can also be used and can be made wholly or substantially air impermeable by spraying it with a coating of the quick-binding cement used for the posts.

The inventon offers exceptional operating economies in that it permits the elimination of many of the traditional mining operations and of the job classifications associated therewith, such as miner, operator and helper, shuttle car operator, roof driller and helper, loading machine operator and helper, cutting machine operator and helper, coal drill operator and helper, laborers to intall ventilation for extensions and laborers to apply rock dust to seal the ribs. The elimination of these job classifications, incidentally, also results in an elimination of the traditional mining hazards associated with these jobs, whereas those jobs created in accordance with the invention (e.g., as a rule one operator for the coal mining machine, two operators for the mechanical roof supports and two operators for the concrete-post erecting equipment) enjoy vastly improved safety conditions due to the superior roof control made possible by the invention. Furthermore, these jobs are simplified by the elimination of the need for intricate job training required by the various machines which are used in the conventional approaches.

While the invention has been illustrated and described as embodied in the mining of coal, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of removing coal from an underground coal panel, comprising the steps of advancing a head gate along one side of the panel and retreating a tail gate along the other side of the panel, while removing coal from a mine face which extends from one to the other of said sides; and setting a plurality of rows of non-yielding roof-support posts of quick-binding concrete along said gates during the advancement and retreat thereof, respectively, and before supported strata above the mine roof can begin to subside.

2. A method as defined in claim 1; and further comprising the step of disposing at least substantially air-impermeable lengths of sheet material along said rows so as to define compartmentalized air and coal passages.

3. A method as defined in claim 1; and further comprising the steps of sealing exposed mine wall surfaces against the escape of methane gas therethrough.

4. A method as defined in claim 3, wherein the step of sealing comprises applying a coating of quick-binding cement slurry to said surfaces.

5. A method as defined in claim 3; and further comprising the step of drilling methane drainage holes at selected sites for allowing controlled escape and recovery of methane.

6. A method as defined in claim 5, wherein said drainage holes are positioned ahead of the advancing mine face; and further comprising the step of admitting water under pressure through said drainage holes into the coal about to be removed, so as to at least reduce the liberation of coal dust during such removal and cause imigration of residual methane gas to an adjacent drainage hole through which it escapes for collection.

7. A method as defined in claim 1, wherein the step of setting comprises erecting said concrete posts in form of two transversely spaced substantially parallel rows which follow behind the retreating mine face.

* * * * *